US010913579B2

(12) United States Patent
Antonelli et al.

(10) Patent No.: US 10,913,579 B2
(45) Date of Patent: Feb. 9, 2021

(54) FITMENT FOR A CONTAINER NECK

(71) Applicant: GCL INTERNATIONAL S.A.R.L., Grand Duchy of Luxembourg (LU)

(72) Inventors: Marco Antonelli, Edinburgh Lothian (GB); Alexander Donald Meiklem McPherson, Falkirk Central (GB); Fraser Walker, Falkirk Central (GB); Allison Weir, New Cumnock East Ayrshire (GB)

(73) Assignee: GCL INTERNATIONAL S.A.R.L., Grand Duchy of Luxembourg (LU)

( * ) Notice: Subject to any disclaimer, the term of this patent is extended or adjusted under 35 U.S.C. 154(b) by 0 days.

(21) Appl. No.: 16/634,573

(22) PCT Filed: Aug. 3, 2018

(86) PCT No.: PCT/EP2018/071121
§ 371 (c)(1),
(2) Date: Jan. 28, 2020

(87) PCT Pub. No.: WO2019/025589
PCT Pub. Date: Feb. 7, 2019

(65) Prior Publication Data

US 2020/0270028 A1 Aug. 27, 2020

(30) Foreign Application Priority Data

Aug. 4, 2017 (GB) ..... 1712591.5
Mar. 28, 2018 (GB) ..... 1805087.2

(51) Int. Cl.
*B65D 41/04* (2006.01)
*B01F 3/04* (2006.01)
*B65D 47/06* (2006.01)

(52) U.S. Cl.
CPC ..... *B65D 41/045* (2013.01); *B01F 3/04787* (2013.01); *B65D 47/06* (2013.01); *B01F 2215/0072* (2013.01)

(58) Field of Classification Search
CPC ..... B65D 51/24; B65D 49/04; B65D 41/045; B65D 41/0435; B65D 41/0414;
(Continued)

(56) References Cited

U.S. PATENT DOCUMENTS 3,073,470 A * 1/1963 Greene ..... B65D 49/06 215/22
3,149,762 A * 9/1964 Decker ..... B65D 47/06 222/478
(Continued)

FOREIGN PATENT DOCUMENTS

EP 0670271 A1 9/1995
GB 2436560 A 10/2007
(Continued)

OTHER PUBLICATIONS

International Search Report and Written Opinion issued in International Application No. PCT/EP2018/071121, dated Nov. 9, 2018; 11 pgs.
(Continued)

*Primary Examiner* — Benjamin R Shaw
(74) *Attorney, Agent, or Firm* — Hauptman Ham, LLP

(57) ABSTRACT

A closure for a container neck comprises a shell and a fitment. The fitment comprises a body and engagement means that extend radially outwardly from the body and releasably retain the fitment within the shell. During application of the closure to the container neck, the engagement means is forced from an extended condition into a retracted
(Continued)

condition to release the fitment from the shell, and the fitment is inserted into the container neck into an operative position.

19 Claims, 8 Drawing Sheets

(58) Field of Classification Search
CPC .... B65D 41/0457; B65D 39/12; B65D 39/14; B01F 3/04787; B01F 2215/0072
USPC ..... 222/566; 215/227, 358
See application file for complete search history.

(56) References Cited

U.S. PATENT DOCUMENTS 4,427,138 A * 1/1984 Heinlein ..... B65D 47/123 222/546
4,821,875 A * 4/1989 Groves ..... B65D 81/3211 206/219
5,454,489 A * 10/1995 Vesborg ..... B65D 47/06 222/109
5,829,608 A * 11/1998 Clerget ..... B65D 41/045 215/44
5,971,179 A * 10/1999 Christmas ..... B65D 49/04 215/18
6,357,614 B1 * 3/2002 Kerr ..... B65D 49/04 215/21
6,533,136 B1 * 3/2003 Willingham ..... B65D 1/023 215/343
6,817,479 B1 * 11/2004 Ferry ..... B65D 41/045 215/18
2004/0069739 A1 * 4/2004 Zumbuhl ..... B65D 41/3442 215/349
2007/0138125 A1 * 6/2007 Granger ..... B65D 41/0435 215/312
2009/0250469 A1 * 10/2009 Heiberger ..... B65B 7/2835 220/378
2014/0284823 A1 * 9/2014 Fraser ..... B01F 5/0428 261/108

FOREIGN PATENT DOCUMENTS

WO 2004/103846 A1 12/2004
WO 2008/059193 A 5/2008
WO 2009/047626 A2 4/2009

OTHER PUBLICATIONS

Search Report issued in United Kingdom Application No. GB1712591.5, dated Jan. 29, 2018; 3 pgs.

* cited by examiner

FITMENT FOR A CONTAINER NECK

RELATED APPLICATIONS

The present application is a National Phase of International Application Number PCT/EP2018/071121 filed Aug. 3, 2018 and claims priority to United Kingdom Application Numbers GB 1712591.5 filed Aug. 4, 2017 and GB 1805087.2 filed Mar. 28, 2018.

FIELD OF THE INVENTION

The present invention relates to a fitment for a container neck, in particular to a fitment that is releasably retained within a closure for a container neck prior to application of the closure to the container neck.

BACKGROUND OF THE INVENTION

In-bore fitments for container necks, such as pourer devices, are known. It is also known to provide a closure for a container neck with an in-bore fitment that is carried in the closure prior to application of the closure to the container neck, and that is inserted into the container neck as the closure is applied to the container neck.

A known type of in-bore fitment is a non-refilling device for preventing tampering with container contents. UK Patent Publication GB 2436560 A discloses a non-refilling device for a container neck, the non-refilling device comprising a housing for insertion into a container neck, a valve member held loosely captive with the housing, and an outwardly projecting annular compliant flange for sealing against the container neck.

International Patent Publication No. WO 2008/059193 A1 discloses a fitment for a bottle closure, the fitment having an annular flange comprising retaining lugs and flange sections, the retaining lugs movable, during application of the bottle closure to a bottle neck, from a first position in which the retaining lugs are engaged with the bottle closure to a second position in which the retaining lugs are not engaged with the bottle closure and seat portions of the flange sections and engagement legs of the retaining lugs abut against the top of the bottle neck.

It is desirable to provide improvements relating to the provision of an in-bore fitment for a container neck.

SUMMARY OF THE INVENTION

According to a first aspect there is provided a closure for a container neck, the closure comprising a shell and a fitment releasably retained within the shell, the fitment configured to be inserted into an operative position within a container neck having a bore diameter D when the closure is applied to the container neck; the fitment comprising a body and engagement means extending radially outwardly from the body; the engagement means in an extended condition relative to the body and releasably engaged with the shell, to releasably retain the fitment within the shell prior to application of the closure to the container neck, the engagement means defining a first span S1 that is greater than the bore diameter D when in said extended condition, and the engagement means configured to be forced into a retracted condition relative to the body during insertion of the fitment into the container neck, to release the fitment from the shell, the engagement means defining a second span S2 that is less than the bore diameter D when in said retracted condition; the engagement means enclosed within the container neck when the fitment is in the operative position.

Thus, prior to application of the fitment to the container neck, the engagement means of the fitment releasably retain the fitment inside closure, and following application of the fitment to the container neck, the engagement means are enclosed within the container neck.

The engagement means may resiliently engage the shell when in the extended condition.

The engagement means may be configured to engage the container neck when in the retracted condition. The engagement means may be configured to resiliently engage the container neck when in the retracted condition.

The engagement means may comprise a plurality of engagement members.

The shell may comprise an annular bead, and the or each engagement member may comprise a lug co-operable with the annular bead.

The body may be tubular, and the engagement members of a plurality of engagement members may be equidistantly spaced around the circumference of the body.

A transition of the engagement means from the extended condition to the retracted condition may comprise one of: a smooth transition phase, a snap transition phase.

The fitment may comprise at least one annular fin for engaging the container neck when the fitment is in the operative position.

The fitment may be a pourer fitment. The fitment may be a non-refillable pourer fitment. The fitment may be an aerator fitment.

The shell may comprise a liner for sealing against a container neck rim.

The shell may be a metal shell. The shell may be an aluminium shell.

In an application, a closure according to the first aspect is provided, in which the closure is for a wine bottle neck, the shell includes a standard liner and the fitment is flangeless and is an aerator/non-refillable in-bore fitment.

According to a second aspect there is provided a fitment adapted for use in the closure of the first aspect.

The fitment is beneficial for facilitating convenient product transportation, for facilitating convenient application to a container neck, and for improving tamper-resistance of the applied closure.

According to a third aspect there is provided a method of providing a container neck with a fitment, the method comprising the steps of: receiving a closure according to the first aspect, receiving a container comprising a container neck having a bore diameter D, and applying the received closure to the received container to insert the fitment into the container neck into the operative position.

The container neck may be a container neck of a glass bottle.

According to a fourth aspect there is provided a container neck having a bore diameter D, the container neck provided with a closure according to the first aspect.

The container may be a glass bottle.

The invention provides a closure for a container neck, the closure comprising a shell and a fitment. The fitment comprises a body and engagement means that extend radially outwardly from the body and releasably retain the fitment within the shell. During application of the closure to the container neck, the engagement means is forced from an extended condition into a retracted condition to release the fitment from the shell, and the fitment is inserted into the container neck into an operative position.

Further particular and preferred aspects of the invention are set out in the claims.

BRIEF DESCRIPTION OF THE DRAWINGS

The present invention will now be more particularly described, with reference to the accompanying drawings, in which.

DESCRIPTION

Example embodiments are described below in sufficient detail to enable those of ordinary skill in the art to embody and implement the apparatus, systems and processes described herein. It is to be understood that embodiments can be provided in many alternate forms and the invention should not be construed as limited to the specific embodiments and examples set forth herein but by the scope of the appended claims.

A fitment for a container neck, a closure for a container neck in which the fitment is releasably retained prior to application of the closure to the container neck, a method of providing a container neck with the fitment, and a container having a container neck provided with the fitment will now be described.

According to the invention, a fitment for a container neck is provided with engagement means for releasably retaining the fitment within a closure for a container neck prior to application of the closure to the container neck and for enclosement within the container neck during application of the closure thereto. In an embodiment, at least each portion of the engagement means that contacts the closure to releasably retain the fitment within the closure are enclosed inside the container neck when the closure is applied thereto. In an embodiment, the fitment comprises engagement means for releasably engaging a shell of a closure for a container neck prior to application of the closure to a container neck and for engaging the container neck following application of the closure to a container neck.

Figure 1:
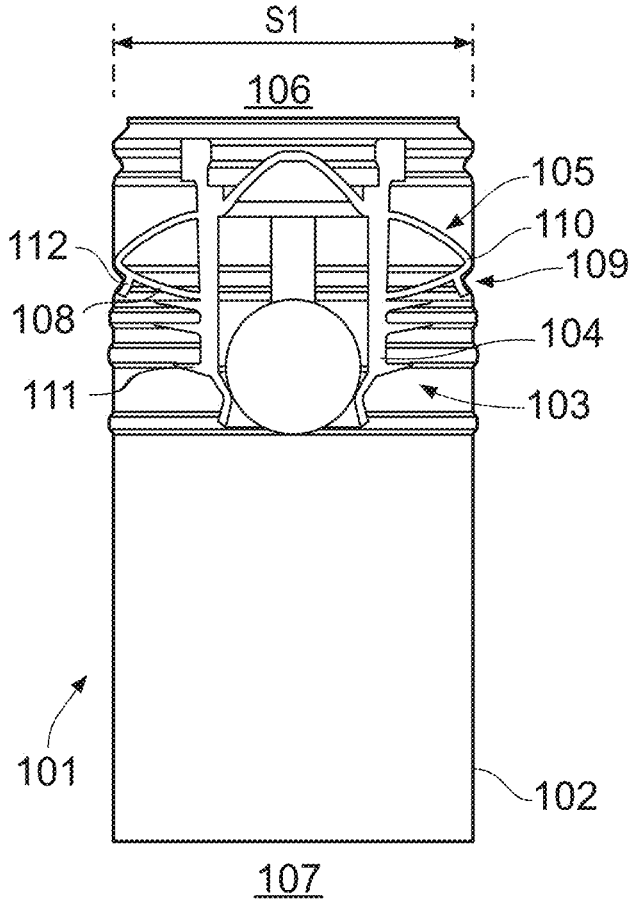
FIG. 1 shows a closure comprising a fitment according to the invention, prior to application to a container neck.
Figure 2:
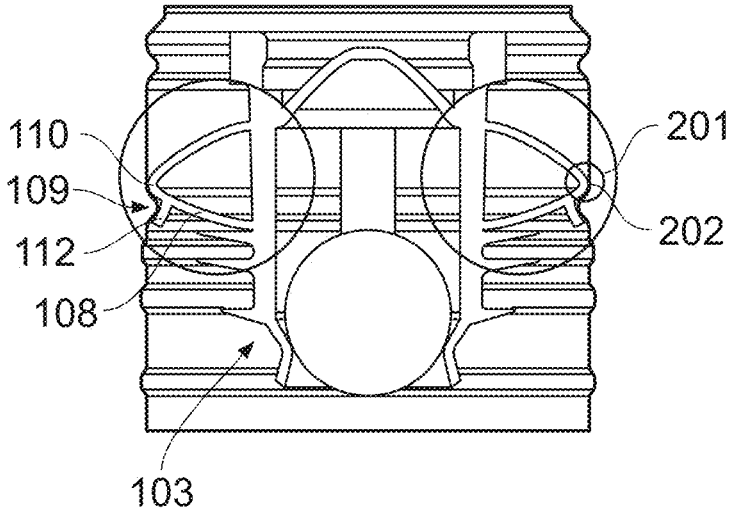
FIG. 2 shows features of the closure of FIG. 1, in further detail.
Figure 3:
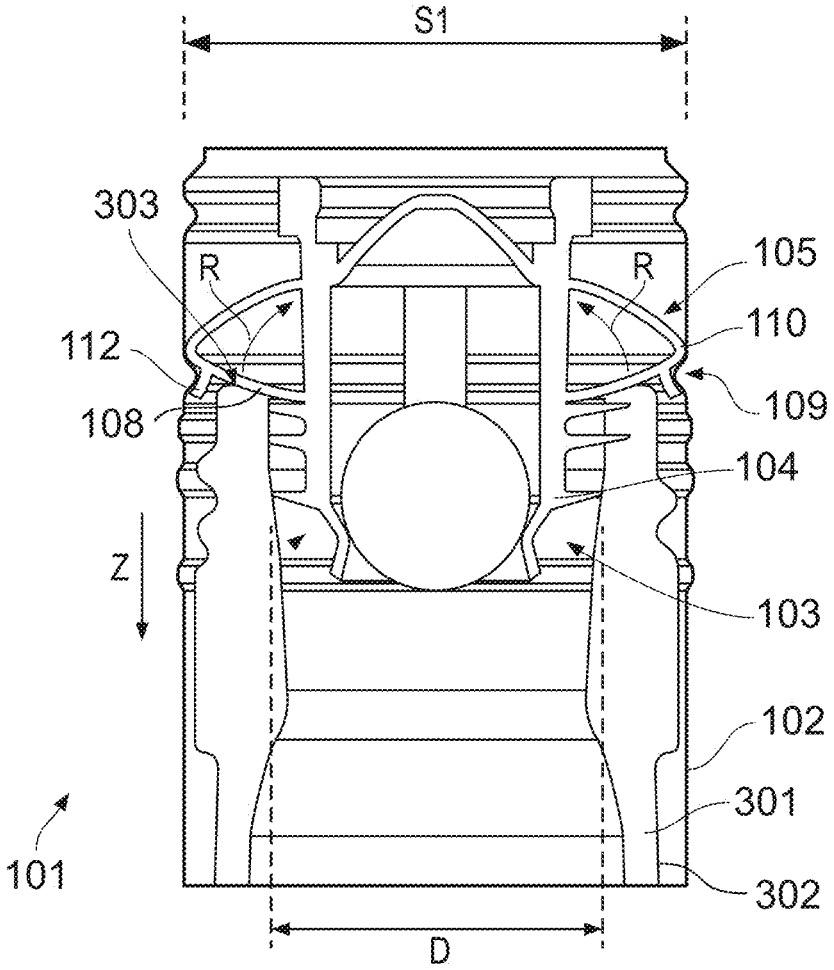
FIG. 3 shows the closure of FIG. 1, during application to a container neck.
Figure 4:
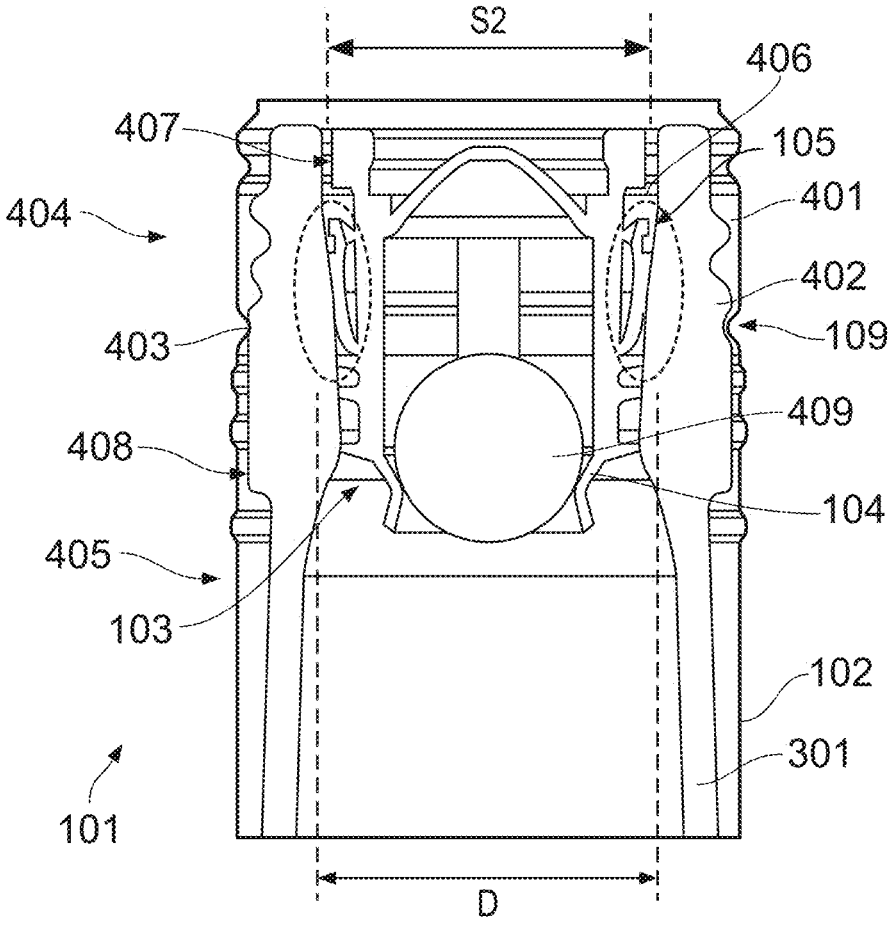
FIG. 4 shows the closure of FIG. 1, following application to a container neck.

A closure 101 is shown in FIGS. 1 to 4. The closure 101 is configured to be applied to a container neck. Closure 101 is shown in FIG. 1 prior to application to a container neck. Features of closure 101 are shown in further detail in FIG. 2. Closure 101 is shown in FIG. 3 during application to a container neck 301 having a bore diameter D, and in FIG. 4 following application to the container neck 301.

Closure 101 comprises a shell 102, and a fitment 103. As illustrated in FIG. 1, prior to application of the closure 101 to the container neck 301, the fitment 103 is releasably retained within the shell 102. As will be described in further detail below, the fitment 103 is configured to be inserted into an operative position within the container neck 301 when the closure 101 is applied to the container neck 301.

Fitment 103 comprises a body 104 and engagement means 105 extending radially outwardly from the body 104. As illustrated in FIG. 1, prior to application of the closure 101 to the container neck 301, the engagement means 105 is in an extended condition relative to the body 104 and releasably engaged with the shell 102, to releasably retain the fitment 103 within the shell 102 prior to application of the closure 101 to the container neck 301. The engagement means 105 defines a first span S1 that is greater than the bore diameter D of the container neck 301 when in the extended condition.

As will be described in further detail, the engagement means 105 is configured to be forced into a retracted condition relative to the body 104 during insertion of the fitment 103 into the container neck 301, to release the fitment 103 from the shell 102 and enable the fitment 103 to be located within the container neck 301. When in the retracted condition, the engagement means 105 defines a second span S2 that is less than the bore diameter D of the container neck 301.

As illustrated in FIG. 3, the engagement means 105 is enclosed within the container neck 301 when the fitment 103 is in the operative position. It is to be appreciated that as the engagement means 105 is fitted within the container neck 301, the second span S2, although nearly equal to, is less than the diameter of the container neck 301 at the position that the engagement means 105 engages the container neck 301.

According to the illustrated embodiment of FIGS. 1 to 4, the engagement means 105 resiliently engages the shell 102 when in the extended condition. In an embodiment, the engagement means 105 is configured to engage the container neck 301. In the illustrated specific embodiment, the engagement means 105 is configured to resiliently engage the container neck 301 when in the retracted condition. In other words, the engagement means 105 is biased towards the extended condition.

Further details of the illustrated specific embodiment will now be described. The shell 102 of the closure 101 has a closed end 106 and an open end 107. The shell 102 is generally tubular, with a generally circular cross-sectional shape.

According to this embodiment, the engagement means 105 comprises a plurality of engagement members 108. In this specific illustrated embodiment, the body 104 of the fitment 103 is generally tubular, and the engagement members 108 are equidistantly spaced around the circumference of the body 104. In this specific illustrated example, the engagement means 105 comprises four engagement members 108. It is to be appreciated however that the engagement means may comprise any suitable number of engagement members, of any suitable type, in any suitable arrangement.

As shown, the shell 102 comprises an annular bead 109. Each engagement member 108 comprises a lug 110 that is co-operable with the annular bead 109.

As can be seen in FIGS. 1 and 2, the diameter of the shell 102 is reduced in the region of the annular bead 109, and when the engagement means 105 is in the extended condition, to releasably retain the fitment 103 within the shell 102, the lug 110 of each engagement member 108 extends behind the annular bead 109. The end portions 201 of the lugs 110 define a virtual circumference, which is generally circular and the diameter of which defines the first span S1. It is to be appreciated that any suitable extent of the virtual circumference may comprise a physical border. As illustrated, the magnitude of the first span S1 is greater than the magnitude of the reduced diameter of the shell 102 in the region of the annular bead 109. Thus, in the shown arrangement, the lugs 110 are latched behind the annular bead 109.

When the fitment 103 is releasably retained within the shell 102, the fitment 103 is in physical contact with the shell 102 at one or more contact points. In the illustrated arrangement, there is a point of contact 202 between the end portion 201 of each lug 110 and the shell 102.

A method of applying the closure 101 to the closure neck 301, during which the fitment 103 is inserted into an operative position within the container neck 301, will now be described, with reference to FIGS. 2 and 3 in particular.

The closure 101 is received, a container comprising the container neck 301 having a bore diameter D is received, and the received closure 101 is applied to the received container to insert the fitment 103 into the container neck 301 into the operative position.

During an alignment step, the closure 101 is moved over the container neck 301 and positioned such that the shell 102 is arranged generally concentrically with the outer surface 302 of the container neck 301.

The closure 101 is then moved downwardly, in the direction indicated by arrow Z, until the shell 102 begins to surround the container neck 301. Travel of the closure 101 along the container neck 301 continues until a position is reached at which the fitment 103 begins to be inserted inside the container neck 301. As mentioned previously, at this stage, the engagement means 105 of the fitment 103 has a first span S1 that is greater than the bore diameter D of the container neck 301. As the closure 101 is moved downwardly over the container neck 301, a position is reached at which the engagement members 108 abut against the rim 303 of the container neck 301, as illustrated in FIG. 2. Continued travel of the closure 101 in the downward direction Z causes the engagement members 108 to be forced upwardly and inwardly towards the body 104 of the fitment 103, as indicated by arrows R. This retracting motion of the engagement members 108 causes the lugs 110 to unlatch from behind the annular bead 109 and, in turn, release the fitment 103 from the shell 102. Further travel of the closure 101 in the downward direction Z pushes the fitment 103 into the operative position within the container neck 301, as illustrated in FIG. 3.

During insertion of the fitment 103 into the container neck 301, the engagement members 108 move closer to the body 104 into a retracted condition in which the engagement means 105 of the fitment 103 has a second span S2 that is less than the bore diameter D of the container neck 301. As can be seen in FIG. 3, when the fitment 103 is in the operative position, the engagement means 105 are enclosed within the container neck 301.

In the present embodiment, the engagement means 105 are released from the shell 102 prior to reaching the retracted condition in which the fitment 103 has a second span S2 that is less than the bore diameter D of the container neck 301. In an alternative embodiment, the engagement means 105 may be released from the shell 102 substantially contemporaneously with the engagement means 105 reaching the retracted condition in which the fitment 103 has a second span S2 that is less than the bore diameter D of the container neck 301.

When the fitment 103 is in the operative position within the container neck 301, the engagement means 105 are enclosed within the container neck 301. At least each portion of the engagement means 105 that was in contact with the closure 101 prior to application of the closure 101 to the container neck 301, to releasably retain the fitment 103 within the closure 101, is enclosed inside the container neck 301 when the fitment 103 is in the operative position therein. This feature beneficially inhibits tampering of the engagement means 105 when the fitment 103 is installed within the container neck 301.

In this specific illustrated embodiment, following application of the closure 101 to the container neck 301, the engagement members 108 are contained within the container neck 301. More specifically, the end portion 201 of each lug 110 is contained within the container neck 301. In the shown arrangement, the engagement means 105 of the fitment 103 do not protrude upwardly from, the rim 303 of the container neck 301.

The design of the engagement means 105 of the fitment 103 of the present invention, which are usable to releasably retain the fitment 103 in a shell 102 of a closure 101 prior to application to a container neck 301, which automatically move into a retracted condition during insertion of the fitment 103 into a container neck 301, and which are fully enclosable within the container neck 301, is beneficial for facilitating convenient product transportation, for facilitating convenient application to a container neck, and for improving tamper-resistance of the applied closure.

The engagement means 105 may be transitioned from the extended condition to the retracted condition by any suitable motion or combination of motions, for example by folding, pivoting, crushing, or squeezing.

The transition of the engagement means 105 from the extended condition to the retracted condition may comprise a smooth transition phase and/or a snap transition phase. In an example, the engagement means 105 are resiliently biased towards the extended condition and are progressively squeezable from the extended condition into the retracted condition. In another example, the engagement means 105 are resiliently biased towards the extended condition and are configured to move gradually from the extended condition into an intermediate condition and then to move suddenly from the intermediate condition into the retracted condition. In such an example, the engagement means, when in the retracted condition, may be biased towards the intermediate condition.

According to this illustrated specific embodiment, the closure 101 is provided with an internal screw-thread 401 that co-operates with an external screw-thread 402 provided on the container neck 301, for opening and closing the container after application of the closure 101 to the container neck 301 thereof.

In this embodiment, the shell 102 is provided with a line of weakness 403, which may comprise a band of reduced wall thickness or a series of frangible bridges, that breaks on first opening of the closure 101 to separate the shell 102 into an upper, removable cap-like portion 404 and a lower, captive skirt-like portion 405. In this embodiment, the fitment 103 is also provided with a line of weakness 406 that breaks on the first opening of the closure 101 to detach a separable portion 407 from a captive portion 408, the separable portion 407 thereafter removable with the upper, removable cap-like portion 402 of the shell 102. When the upper, removable cap-like portion 404 of the shell 102 together with the separable portion 407 of the fitment 103 is removed, the lower, captive skirt-like portion 405 of the shell 102 remains on the container neck 301 and the captive portion 408 of the fitment 103 remains inside the container neck 301. In this example, the line of weakness 403 of the shell 102 is located at the position of the annular bead 109.

In this embodiment, the fitment 103 is provided with a ball valve 409, which aids the mixing of contents with air during pouring.

The closure may be made from any suitable material or combination of materials, and may be made using any suitable manufacturing method, technique or process or any suitable combination of manufacturing methods, techniques or processes.

In an embodiment, the shell is made from a metal material. In the illustrated specific embodiment, the shell 102 is an aluminium shell. In an embodiment, the shell comprises a liner for sealing against a container neck rim.

The fitment may be made from a plastics material. In an embodiment, the fitment further comprises at least one annular fin for engaging the container neck when the fitment is in the operative position. In the illustrated specific embodiment, the fitment 103 further comprises a plurality of annular fins 111, which extend radially outwardly outward of the body 104 and are spaced in the axial direction of the body 104, for sealing against the inside surface of the container neck 301. Optionally, and in the illustrated specific embodiment, the engagement members 108 comprise a location element 112 that extends under the annular bead 108 of the shell 102 when the lugs 110 are latched behind the annular bead 108.

The fitment may be any suitable type of fitment. In an embodiment, the fitment is a pourer fitment. In a specific embodiment, the fitment is a non-refillable pourer fitment.

In an embodiment, the fitment is an aerator fitment. Thus, the fitment may have a flow regulation and/or a tamper-evidence and/or a flavour enhancement purpose.

The fitment may be used in any suitable container having a container neck. The container may be made from any suitable material or combination of materials. In an example, the container is a bottle. In a specific example, the container is a glass bottle. The container may contain any suitable contents. In an example, the container contains an alcoholic beverage. In a specific example, the container contains wine.

In an illustrative application, the closure is for a wine bottle neck, the shell includes a standard liner and the fitment is flangeless and is an aerator/non-refillable in-bore fitment.

The fitment may be used in a closure that has a cap part that is removable by a pulling or a screwing action.

Figure 5:
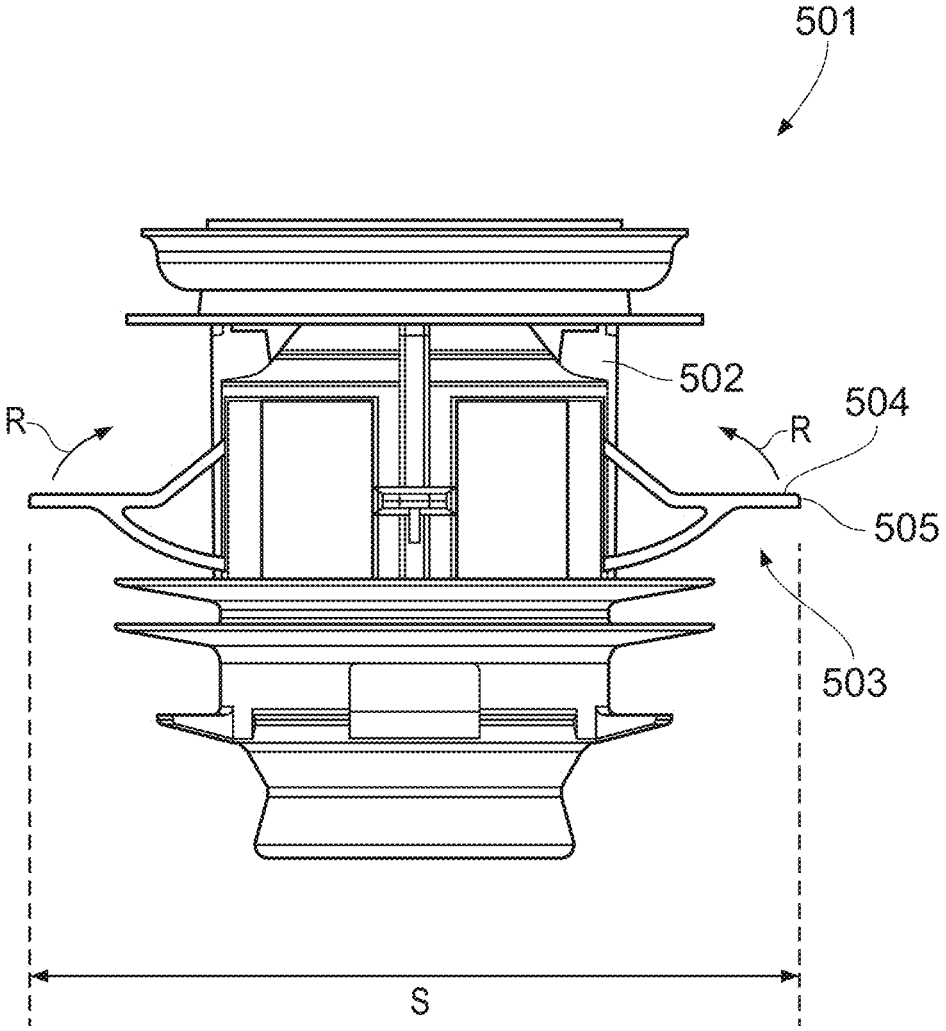
FIG. 5 shows another fitment according to the invention.

A fitment 501 adapted for use in a closure as described herein is shown in FIG. 5. The fitment 501 comprises a body 502 and engagement means 503 that are movable relative to the body 502 between an extended condition (shown) and a retracted condition (not shown). The magnitude of the span S of the fitment 501 decreases as the engagement means 503 moves from the extended condition into the retracted condition. The engagement means 503 comprises a plurality of engagement members 504, each engagement member 504 comprising a lug 505. The engagement members 504 are movable relative to the body 502 in the direction indicated by arrow R. The engagement members 504 are biased towards the extended condition.

The fitment 501 is arranged to be assembled with a closure shell (not shown) having an annular bead, simply a simple pushing action to insert the fitment 501 into the closure shell so that the lugs 505 of the engagement members 504 can be pushed over the annular bead and snapped into a latched condition behind the annular bead. The fitment 501 is then held in the closure shell by the engagement means 503 until it is time for the closure to be applied to a container neck.

To fit the fitment into a container neck, the fitment is presented to the container neck and simply moved downwards onto the container neck, which causes the fitment to enter the container neck and be pushed into the operative position. As mentioned above, the body of the fitment may comprise a detachable portion that is separated from the body during first opening of the closure and that is removable together with a removable portion of the closure.

In an embodiment, the fitment comprises a barrier feature to inhibit access to the engagement means after the fitment has reached the operative position with a container neck.

Figure 6:
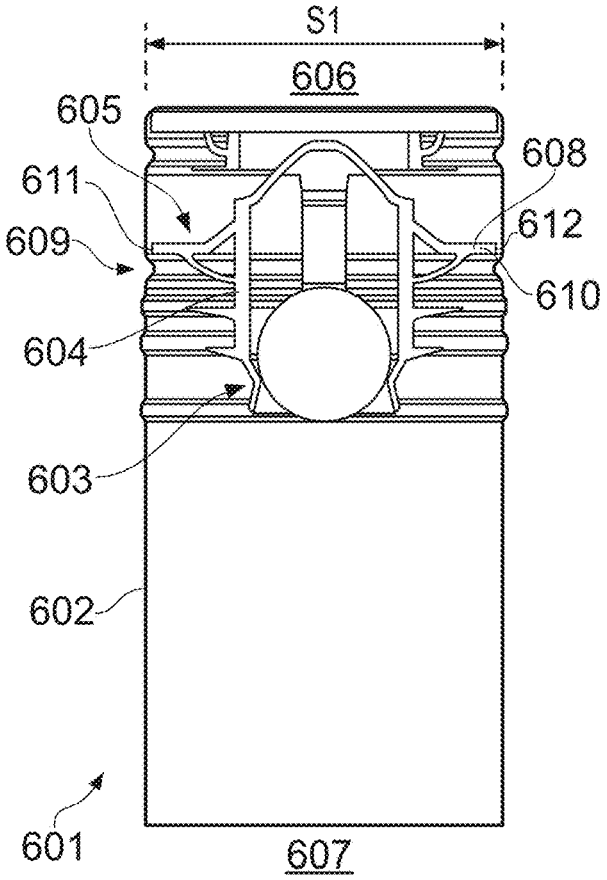
FIG. 6 shows another closure comprising a fitment according to the invention, prior to application to a container neck.
Figure 7:
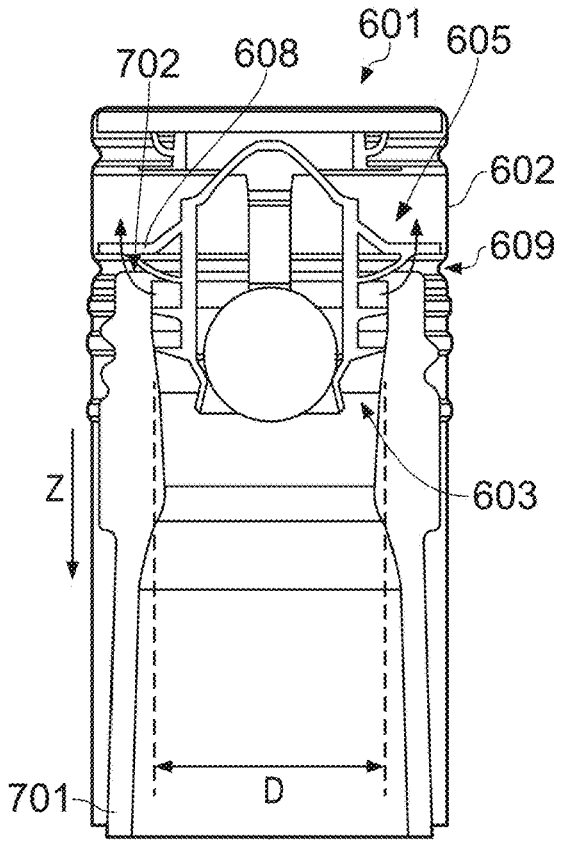
FIG. 7 shows the closure of FIG. 6, during application to a container neck.
Figure 8:
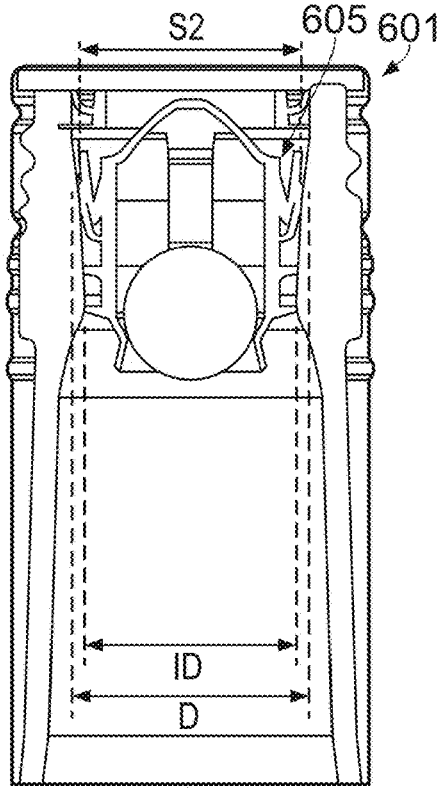
FIG. 8 shows the closure of FIG. 6, following application to a container neck.

A closure 601 is shown in FIGS. 6 to 8. The closure 601 is configured to be applied to a container neck. Closure 601 is shown in FIG. 6 prior to application to a container neck, in FIG. 7 during application to the container neck 701 having a bore diameter D, and in FIG. 8 following application to the container neck 701.

Closure 601 comprises a shell 602 and a fitment 603, the fitment 603 releasably retained within the shell 602. The fitment 603 is configured to be inserted into an operative position within the container neck 701 when the closure 601 is applied to the container neck 601.

Fitment 603 comprises a body 604 and engagement means 605 extending radially outwardly from the body 604. As illustrated in FIG. 6, prior to application of the closure 601 to the container neck 701, the engagement means 605 is in an extended condition relative to the body 604 and releasably engaged with the shell 602. When in the extended condition, the engagement means 605 defines a first span S1 that is greater than the bore diameter D of the container neck 701.

The engagement means 605 is configured to be forced into a retracted condition relative to the body 604 during insertion of the fitment 603 into the container neck 701, to release the fitment 603 from the shell 602 and enable the fitment 603 to be located within the container neck 701. When in the retracted condition, the engagement means 605 defines a second span S2 that is less than the first span S1.

According to the illustrated embodiment of FIGS. 6 to 8, the engagement means 605 is biased towards the extended condition and configured to resiliently engage the container neck 701 when in the retracted condition.

As illustrated in FIG. 8, the engagement means 605 is enclosed within the container neck 701 when the fitment 603 is in the operative position.

Further details of the illustrated specific embodiment will now be described. The shell 602 of the closure 602 has a closed end 606 and an open end 607, and is generally tubular, with a generally circular cross-sectional shape.

According to this embodiment, the engagement means 605 comprises a plurality of engagement members 608. In this specific illustrated embodiment, the body 604 of the fitment 603 is generally tubular.

As shown, the shell 602 comprises an annular bead 609. Each engagement member 608 comprises an arm 610 that is co-operable with the annular bead 609 of the shell 602.

As can be seen in FIG. 6, the internal diameter of the shell 602 is reduced in the region of the annular bead 609, and when the engagement means 605 is in the extended condition, to releasably retain the fitment 603 within the shell 602, the arm 610 of each engagement member 608 extends behind the annular bead 609. In this way, the arm 610 of each engagement member 608 sits upon the annular bead 609. The end portions 611 of the lugs arms define a virtual circumference, which is generally circular and the diameter of which defines the first span S1. It is to be appreciated that any suitable extent of the virtual circumference may comprise a physical border. As illustrated, the magnitude of the first span S1 is greater than the magnitude of the reduced diameter of the shell 102 in the region of the annular bead 609. Thus, in the shown arrangement, the arms are latched behind the annular bead 609.

When the fitment 603 is releasably retained within the shell 602, the fitment 603 is in physical contact with the shell 602 at one or more contact points. In the illustrated arrangement, there is a point of contact 612 between the end portion 611 of each arm 610 and the shell 602.

FIG. 7 shows the closure 601 being applied to the closure neck 601, during which the fitment 603 is inserted into an operative position within the container neck 701.

The closure 601 is received, a container comprising the container neck 701 having a bore diameter D is received, and the received closure 601 is moved over the container neck 701, in the direction indicated by arrow Z, to insert the fitment 603 into the container neck 601 into the operative position.

During this process, the span of the engagement means 605 of the fitment 603 is caused to reduce from the first span S1 to a second, smaller span 602. As the closure 601 is moved downwardly over the container neck 701, a position is reached at which the engagement members 608 abut against the rim 702 of the container neck 701, and continued travel of the closure 701 in the downward direction Z causes the engagement members 608 to be forced upwardly and inwardly, as indicated by arrows R. This retracting motion of the engagement members 608 causes the arms 610 to unlatch from behind the annular bead 609 and, in turn, release the fitment 603 from the shell 602. Further travel of the closure 601 in the downward direction Z pushes the fitment 603 into the operative position within the container neck 701, with the engagement members 608 engaging the container neck 701 to retain the fitment 603 therein.

It is to be appreciated that the first span S1 is greater than the internal diameter of the container neck 701 at the position at which the engagement members 608 engage the container neck 701 when the fitment 603 is in the operative position therein and that the second span S2 is smaller than, but nearly equal to, the internal diameter of the container neck 701 at the position at which the engagement members 608 engage the container neck 701 when the fitment 603 is in the operative position therein. It is further to be appreciated that the internal diameter of a container neck can vary in the depth direction thereof. According to the container neck 701 shown in FIGS. 7 and 8, the internal diameter ID of the container neck 701 at the position at which the engagement members 608 engage the container neck 701 when the fitment 603 is in the operative position therein is smaller than the bore diameter D, this being the internal diameter of the open end of the container neck 701.

Figure 9:
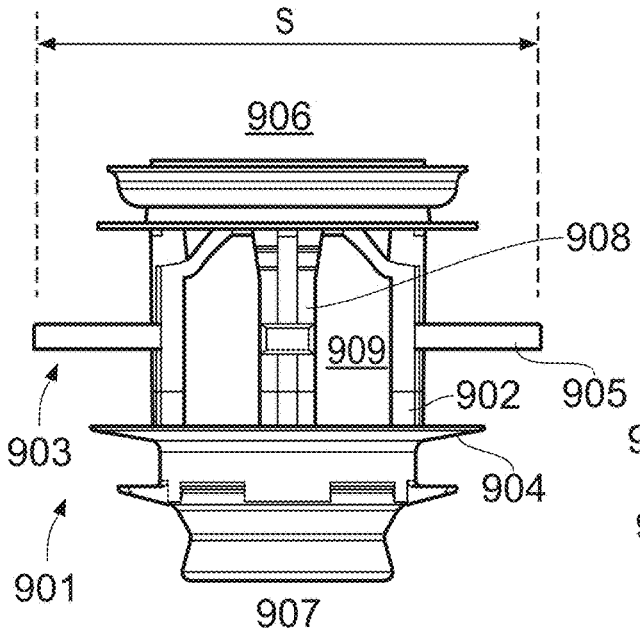
FIG. 9 shows a side view of a further fitment according to the invention.
Figure 10:
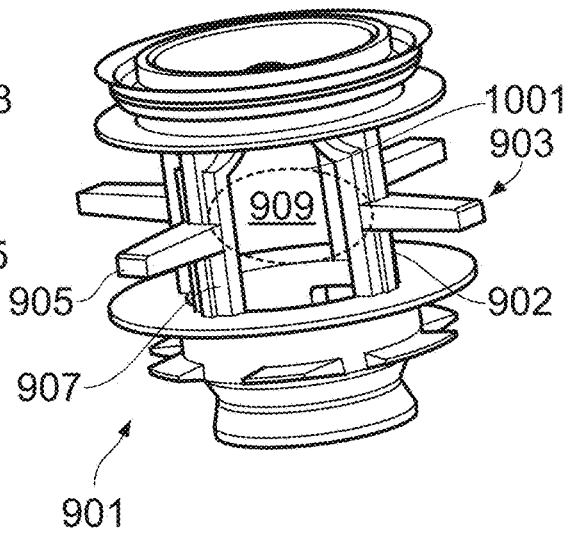
FIG. 10 shows a perspective view of the fitment of FIG. 9.
Figure 11:
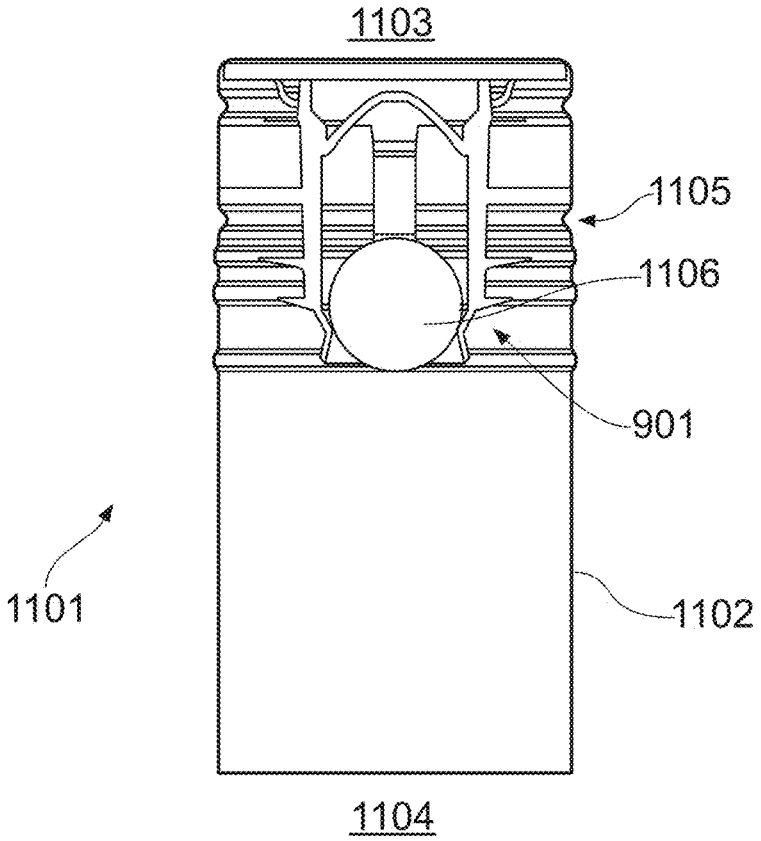
FIG. 11 shows a closure provided with the fitment of FIG. 9.

A fitment 901 is shown in FIGS. 9 to 11. The fitment 901 is configured to be inserted into a container neck into an operative position. A side view of fitment 901 is shown in FIG. 9, and a perspective view is shown in FIG. 10. A closure 1101 comprising the fitment 901 is shown in FIG. 11, prior to application to a container neck.

Referring to FIGS. 9 & 10, fitment 901 comprises a body 902 and engagement means 903 extending radially outwardly from the body 902. Prior to insertion of the closure 901 into a container neck, the engagement means 903 is in an extended condition relative to the body 902. When in the extended condition, the engagement means 1203 defines a first span S.

The engagement means 903 is configured to retract to define a second span, the second span less than the first span S, during insertion of the fitment 901 into a container neck. When the fitment 901 has been inserted into a container neck into the operative position, the engagement means 903 retain the fitment 901 in an operative position inside the container neck.

According to this example, the fitment 901 comprises at least one annular fin 904, which extends radially outwardly outward of the body 902, for sealing against the inside surface of the container neck.

The body 902 of the fitment 901 has an upper end 905 and a lower end 906. The body 902 comprises a plurality of posts 907 that extend longitudinally between the upper end 905 and the lower end 906 and that define an interior region 908.

The engagement means 903 comprises a plurality of resiliently bendable ribs 905. In this example, the engagement means 903 comprises four resiliently bendable ribs 905, which are equidistantly distributed around a circumference 1001 defined by the body 902 of the fitment 901. In this example, the body 902 comprises four posts 907, which are also equidistantly distributed around a circumference 1001. Each of the resiliently bendable ribs 905 of the engagement means 903 extends from one of the posts 907 of the body 902.

Referring to FIG. 11, closure 1101 comprises a shell 1102 and fitment 901. The shell 1102 has a closed end 1103 and an open end 1104 and defines an annular bead 1105. The fitment 901 is releasably retained within the shell 1202 by means the resiliently bendable ribs 905 of the engagement means 905, which latch behind the annular bead 1105 when the fitment 901 is inserted into the shell 1202. As the fitment 901 enters the shell 1102, through the open end 1104, the resiliently bendable ribs 905 abut against the underside of the annular bead 1105. As the fitment 901 is introduced further into the shell 1102, the resiliently bendable ribs 905 arch inwards and downwards to pass beyond the annular bead 1105. As the upper end 906 of the fitment 901 progresses closer to the closed end 1103 of the shell 1102, the resiliently bendable ribs 905 straighten again to extend over the upper side of the annular bead 1105. The fitment 901 is subsequently held in place within the shell 1102, prior to application of the closure 1101 to a container neck, by means of the resiliently bendable ribs 905 being latched behind the annular bead 1105.

As the closure 901 is applied to a container neck, the shell 1102 moves over the container neck until the resiliently bendable ribs 905 meet the rim thereof. As the closure 901 is moved further onto the container neck, the resiliently bendable ribs 905 arch upwards to become unlatched from behind the annular bead 1105. This causes the fitment 901 to become released from the shell 1102 and engaged with the interior of the container neck. The resiliently bendable ribs 905 are biased towards the straight condition shown in FIGS. 9 to 11 and, as a result, exert a force against the inside of the container neck that holds the fitment 901 in place within the bore of the glass.

The closure 1101 further comprises a liner 1106 located within the shell 1202 and positioned against the underside of the closed end 1103. The liner 1106 is provided for sealing the upper end 906 of the body 902 of the fitment 901.

Fitment 901 is a non-refillable wine aerator fitment for use with a glass wine bottle. The fitment 901 is provided with a ball valve 1106, housed within the interior chamber 909 of the body 902. The ball valve 1106 functions to cause mixing of wine being poured from the bottle with air.

Figure 12:
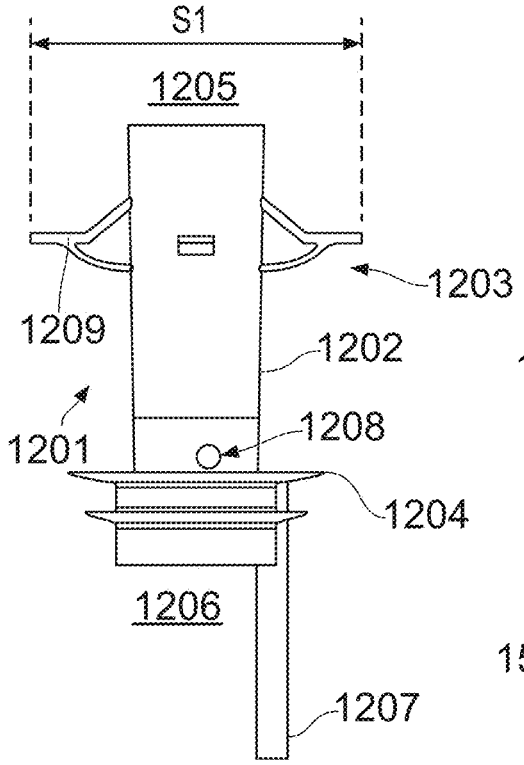
FIG. 12 shows a side view of yet another fitment according to the invention.

A fitment 1201 is shown in FIGS. 12 to 15. The fitment 1201 is configured to be inserted into a container neck into an operative position. A side view of fitment 1201 is shown in FIG. 9, a bottom view is shown in FIG. 10, and a top view 1201 is shown in FIG. 11. A closure 1501 comprising the fitment 1201 is shown in FIG. 12, prior to application to a container neck.

Figure 13:
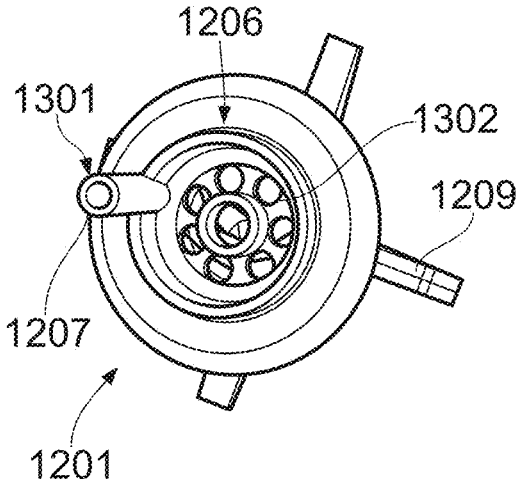
FIG. 13 shows a bottom view of the fitment of FIG. 12.
Figure 14:
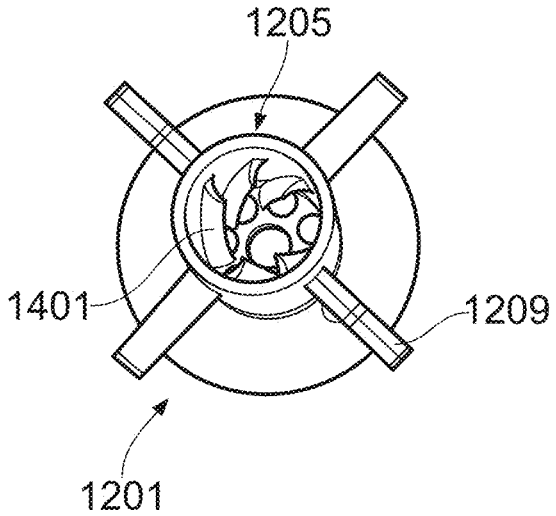
FIG. 14 shows a top view of the fitment of FIG. 12.

Referring to FIGS. 12 to 14, fitment 1201 comprises a body 1202 and engagement means 1203 extending radially outwardly from the body 1202. Prior to insertion of the closure 1201 into a container neck, the engagement means 1203 is in an extended condition relative to the body 1202. When in the extended condition, the engagement means 1203 defines a first span S1.

The engagement means 1203 is configured to retract to define a second span, the second span less than the first span S1, during insertion of the fitment 1201 into a container neck. When the fitment 1201 has been inserted into a container neck into the operative position, the engagement means 1203 engage the internal surface of the container neck to retain the fitment 1201 therein.

According to this example, the fitment 1201 comprises at least one annular fin 1204, which extends radially outwardly outward of the body 1202, for sealing against the inside surface of the container neck.

Fitment 1201 is an aerator fitment, which may be used on a wine bottle. The fitment 1201 utilises the venturi effect. The fitment 1201 defines an upper end 1205 and a lower end 1206. A dip tube 1207 extends downwardly from the lower end 1205. The dip tube 1207 allows air into the container. The body 1202 defines at least one ventilation aperture 1208 therein, towards or at the lower end 1206. According to the shown arrangement, at least one ventilation aperture 1208 is above the at least one annular fin 1204 and an aperture 1301 of the dip tube 1207 is below the at least one annular fin 1204. An apertured baffle 1302 is provided, towards or at the lower end 1206 of the body 1202, to restrict the flow and increase the velocity at which contents are dispensed from the container through the fitment 1201. A helical arrangement of paddles 1401 is provided within the upper 1205 of the body 1202, which aids the mixing of contents with air during pouring.

The engagement means 1203 comprises a plurality of resiliently retractable arms 1209.

Figure 15:
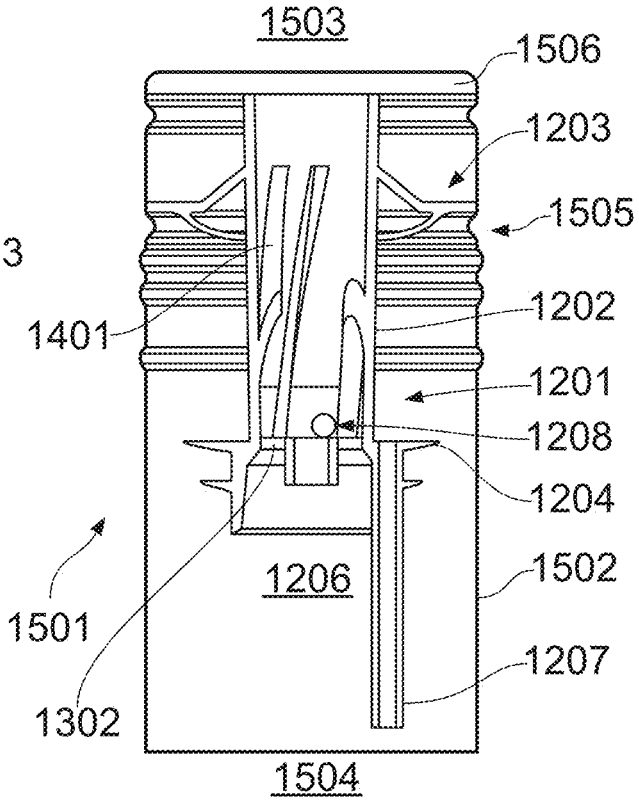
FIG. 15 shows a closure provided with the fitment of FIG. 12.

Referring to FIG. 15, closure 1501 comprises a shell 1502, the shell 1502 having a closed end 1503 and an open end 1504, and the shell defining an annular bead 1505, and the fitment 1201, the fitment 1201 releasably retained within the shell 1502 by means of the plurality of resiliently retractable arms 1210 of the engagement means 1203 being clipped behind the annular bead 1505. The closure 1501 further comprises a liner 1506 located within the shell 1502 and positioned at the closed end 1503. The liner 1506 is provided for sealing the upper end 1205 of the body 1202 of the fitment 1201.

As the fitment 1201 is inserted into the shell 1502, the engagement means 1203 meets the annular bead 1505 and the resiliently retractable arms 1209 of the fitment 1201 first retract and then expand, to flex beyond the annular bead 1505 of the shell 1202 to hold the fitment 1201 in place prior to application of the closure 1501 to a container neck. As the closure 1201 is applied to a container neck, the shell 1202 moves over the container neck and the engagement means 1203 meets the rim of the container neck and the resiliently retractable arms 1209 of the fitment 1201 are crushed into a compressed condition, to release the fitment 1201 from the shell 1202 and engage the interior of the container neck to hold the fitment 1201 in place within the container neck.

Figure 16:
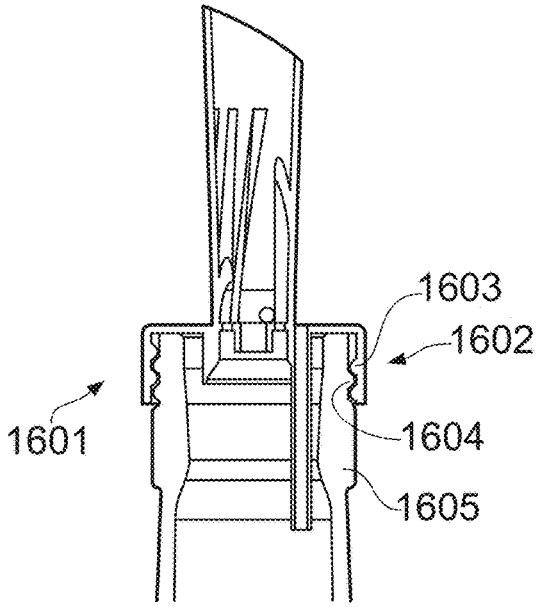
FIG. 16 shows an alternative fitment.

A fitment 1601 is shown in FIG. 16. Fitment 1601 differs from fitment 1201 in that it does not comprise the engagement means 1203 and the at least one annular fin 1204 but comprises an engagement portion 1602 comprising an internal screw thread 1603 for co-operating an external screw thread 1604 provided on the exterior of a container neck 1605, and in that the fitment 1601 is not enclosed within the container neck 1605 when applied thereto. The fitment 1601 may be provided with a washer, which may be a rubber washer, for sealing against a container, for example a glass bottle.

The screw-on feature of the engagement portion 1602 allows the fitment 1601 to be purchased as a separate item for use with screw cap bottles.

Figure 17:
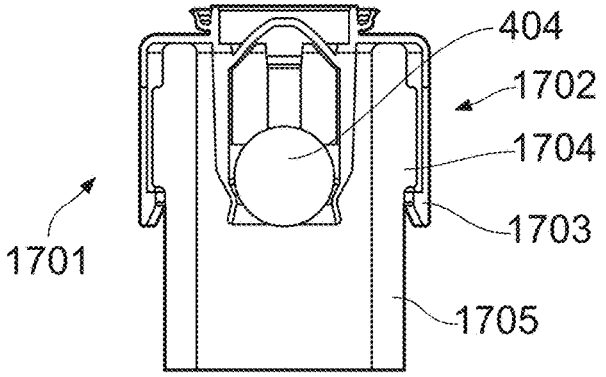
FIG. 17 shows a further alternative fitment.

A further fitment 1701 is shown in FIG. 17. Fitment 1701 differs from fitment 103 in that it does not comprise the engagement means 105 and the plurality of annular fins III but comprises an engagement portion 1702 comprising a plurality of clip members 1703 for latching behind a shoulder 1704 provided on the exterior of a container neck 1705, and in that the fitment 1701 is not enclosed within the container neck 1705 when applied thereto. The fitment 1701 may be provided with a washer, which may be a rubber washer, for sealing against a container, for example a glass bottle. The fitment 1701 may be provided with a surface of copper material that is exposed to the flow of liquid therethrough. In this example, the fitment 1701 is provided with a ball 409 that is fabricated from, or provided with an outer layer of, copper. This fitment is particularly suitable for use with a wine bottle, as during pouring the wine is exposed to the copper, which serves to draw sulphites from the wine to provide a cleaner taste.

The snap-on feature of the engagement portion 1702 allows the fitment 1701 to be purchased as a separate item for use with corked bottles.

It is to be appreciated that a variant of the fitment 1601 of FIG. 16 is provided with a snap-on engagement portion similar to that of the fitment 1701 of FIG. 17 and a variant of the fitment 1471 of FIG. 17 is provided with a screw-on engagement portion similar to that of the fitment 1601 of FIG. 16.

Figure 18:
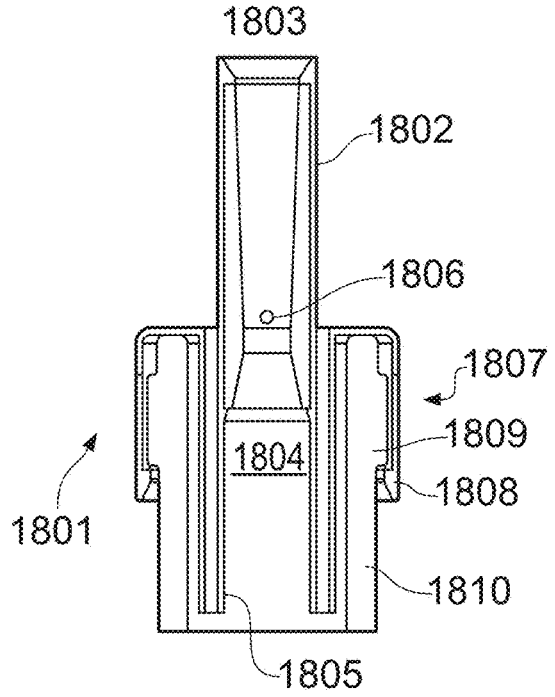
FIG. 18 shows another alternative fitment.

Another fitment 1801 is shown in FIG. 18. Fitment 1801 comprises a body 1802 having an upper end 1803 and a lower end 1804. At least one dip tube 1805 extends downwardly from the lower end 1804. The body 1802 defines at least one ventilation aperture 1806 therein, towards or at the lower end 1804. The fitment 1801 has an engagement portion 1807 comprising a plurality of clip members 1808 for latching behind a shoulder 1809 provided on the exterior of a container neck 1810. The fitment 1801 may be provided with a washer, which may be a rubber washer, for sealing against a container, for example a glass bottle.

The fitment 1501 may be provided with a surface of copper material that is exposed to the flow of liquid therethrough. According to this example, the fitment 1501 is fabricated mainly from a plastics material but is provided with an inner sleeve 1511 that is fabricated from, or provided with an inner layer of, copper. The inner sleeve 1511 may be moulded into the plastics material forming the main fitment. This fitment is particularly suitable for use with a wine bottles, as the copper to which the wine is exposed during pouring serves to draw sulphites from the wine to provide a cleaner taste.

Figure 19:
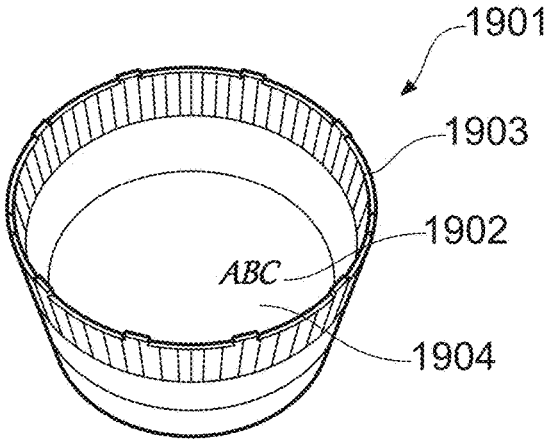
FIG. 19 shows a screw cap.

A cap 1901 is shown in FIG. 19. In this example, the cap 1901 is a screw cap. The cap 1901 is provided with an indicium or indicia 1902 that is formed using a laser etching process. The indicium or indicia 1902 may be provided on an internal surface 1903 of a liner 1904 retained within the cap 1901.

This approach allows information or promotional codes, logos or messages to be presented with control, accuracy and repeatability and with associated speed of customisation.

A closure and/or a fitment as described herein may comprise one or more other features not explicitly disclosed herein, for example sealing or tamper-evidence features.

A fitment as described herein may be a unitary component or comprise a body that is a unitary component, which may be injection moulded from a plastics material such as polypropylene. A closure as described herein may comprise a metal shell. A closure as described herein may comprise a liner that is a tin/polyvinylidene chloride (PVDC) liner.

The invention thus provides a closure for a container neck comprising a fitment, a fitment adapted for use in the closure, a method of providing a container neck with the fitment, and a container having a container neck provided with the fitment.

Although illustrative embodiments of the invention have been disclosed in detail herein, with reference to the accompanying drawings, it is to be understood that the invention is not limited to the precise embodiments and examples shown and that various changes and modifications can be effected therein by one skilled in the art without departing from the scope of the invention as defined by the appended claims.

The invention claimed is:

1. A closure for a container neck, the closure comprising a shell and a fitment releasably retained within the shell, the fitment configured to be inserted into an operative position within a container neck having a bore diameter D when the closure is applied to the container neck;

the fitment comprising a body and engagement means extending radially outwardly from the body;

the engagement means in an extended condition relative to the body and releasably engaged with the shell, to releasably retain the fitment within the shell prior to application of the closure to the container neck, the engagement means defining a first span S1 that is greater than the bore diameter D when in said extended condition, and the engagement means configured to be forced into a retracted condition relative to the body during insertion of the fitment into the container neck, to release the fitment from the shell, the engagement means defining a second span S2 that is less than the bore diameter D when in said retracted condition;

the engagement means enclosed within the container neck when the fitment is in the operative position.

2. A closure as claimed in claim 1, wherein the engagement means resiliently engages the shell when in the extended condition.

3. A closure as claimed in claim 1, wherein the engagement means is configured to engage the container neck when in the retracted condition.

4. A closure as claimed in claim 3, wherein the engagement means is configured to resiliently engage the container neck when in the retracted condition.

5. A closure as claimed in claim 1, wherein the engagement means comprises a plurality of engagement members.

6. A closure as claimed in claim 5, wherein the shell comprises an annular bead, and each engagement member comprises a lug co-operable with the annular bead.

7. A closure as claimed in claim 5, wherein the body is tubular, and the engagement members of the plurality of engagement members are equidistantly spaced around a circumference defined by the body.

8. A closure as claimed in claim 1, wherein a transition of the engagement means from the extended condition to the retracted condition comprises one of: a smooth transition phase, a snap transition phase.

9. A closure as claimed in claim 1, wherein the fitment comprises at least one annular fin for engaging the container neck when the fitment is in the operative position.

10. A closure as claimed in claim 1, wherein the fitment is a pourer fitment.

11. A closure as claimed in claim 10, wherein the fitment is a non-refillable pourer fitment.

12. A closure as claimed in claim 1, wherein the fitment is an aerator fitment.

13. A closure as claimed in claim 1, wherein the shell comprises a liner for sealing against a container neck rim.

14. A closure as claimed in claim 1, wherein the shell is a metal shell.

15. A closure as claimed in claim 14, wherein the shell is an aluminium shell.

16. A method of providing a container neck with a fitment, the method comprising the steps of:

receiving a closure as claimed in claim 1, receiving a container comprising a container neck having a bore diameter D, and applying the received closure to the received container to insert the fitment into the container neck into the operative position.

17. A method as claimed in claim 16, wherein the container neck is a container neck of a glass bottle.

18. A container comprising a container neck having a bore diameter D, the container neck provided with the closure of claim 1.

19. A container as claimed in claim 18, wherein the container is a glass bottle.

* * * * *